US006730253B2

(12) United States Patent
Etesse

(10) Patent No.: US 6,730,253 B2
(45) Date of Patent: May 4, 2004

(54) PROCESS FOR THE MANUFACTURE OF A SHRINK SLEEVED BOTTLE WITH A HANDLE

(75) Inventor: Patrick Jean-François Etesse, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 97 days.

(21) Appl. No.: 10/093,043

(22) Filed: Mar. 7, 2002

(65) Prior Publication Data

US 2002/0124931 A1 Sep. 12, 2002

(30) Foreign Application Priority Data

Mar. 8, 2001 (EP) ..... 01200914

(51) Int. Cl.[7] ..... B29C 61/02
(52) U.S. Cl. ..... 264/230; 264/342 R
(58) Field of Search ..... 264/230, 342 R

(56) References Cited

U.S. PATENT DOCUMENTS

| | | | | |
|---|---|---|---|---|
| 4,051,265 | A | | 9/1977 | Kirshenbaum et al. |
| 4,257,525 | A | | 3/1981 | Thompson |
| 4,368,827 | A | | 1/1983 | Thompson |
| 4,629,598 | A | | 12/1986 | Thompson |
| 5,122,399 | A | | 6/1992 | Farrell et al. |
| 5,383,558 | A | | 1/1995 | Wilkinson et al. |
| 5,524,787 | A | | 6/1996 | Blake et al. |
| 5,676,314 | A | | 10/1997 | Brass et al. |
| 5,711,061 | A | * | 1/1998 | Blake et al. ..... 29/516 |
| 5,783,138 | A | * | 7/1998 | Takeuchi ..... 264/537 |
| 5,836,469 | A | | 11/1998 | Zebrowski |
| 2002/0153345 | A1 | | 10/2002 | Johnson, et al. |

FOREIGN PATENT DOCUMENTS

| | | |
|---|---|---|
| CN | 1023099 C | 12/1993 |
| CN | 0 609 644 A1 | 8/1994 |
| CN | 0 785 146 A1 | 7/1997 |
| EP | 0 483 976 A1 | 5/1992 |
| EP | 0 609 575 A1 | 8/1994 |
| EP | 1 083 041 A1 | 3/2001 |
| EP | 1 083 129 A1 | 3/2001 |
| EP | 1 176 100 A1 | 1/2002 |
| JP | 52-56695 | 5/1977 |
| WO | WP 01/19692 A1 | 3/2001 |

* cited by examiner

*Primary Examiner*—Suzanne E. McDowell
(74) *Attorney, Agent, or Firm*—Jeffrey V. Bamber

(57) ABSTRACT

A process of forming a shrink-sleeved bottle with a handle is disclosed. In one embodiment, the process forms a bottle in which the handle is substantially exposed outside the bottle.

7 Claims, 4 Drawing Sheets

PROCESS FOR THE MANUFACTURE OF A SHRINK SLEEVED BOTTLE WITH A HANDLE

TECHNICAL FIELD

The present invention relates to a process for the manufacture of a decorated bottle, the bottle having a handle. In particular it relates to a bottle having a decorated sleeve shrunk around the outside of the bottle.

BACKGROUND OF THE INVENTION

Bottles are widely used in consumer goods industry for packaging various type of fluid products. Such bottles are normally decorated, often using labels which are stuck onto the bottle. Such labels are typically used not only for decoration but also to display usage instructions or information on the composition of the content for example. However, conventional labelling technology such as wet glue labels, self-adhesive labels, or in mold labels do not allow to decorate the full bottle surface area. The accumulation of such visual signals led the industry to develop new approaches allowing higher decoration coverage of the container's surface, one of these new approaches being the shrink-sleeving of packages.

Shrink-sleeving is mostly used in the drinks industry, whereby a sleeve of thermoplastic material may be shrunk all around a beverage bottle, thus offering an extended area which may be used for any type of graphics. Typical thermoplastic materials used for shrink sleeving include polyvinylchloride (PVC); low or high density polyethylene (LDPE, HDPE); polyester teraphthalate (PET); polypropylene (PP) and oriented polypropylene (OPP); polystyrene (PS) and oriented polystyrene (OPS); and mixtures thereof.

However, use of shrink-sleeving did not extend to relatively larger containers, particularly because of the need of a side handle when such containers are used. Indeed, the sleeving of a bottle consists in inserting the bottle into a straight sleeve of thermoplastic material, the thermoplastic then being heated to shrink and fit tightly around the container. Clearly, in case of a container or bottle having a side handle, such a process would lead to preventing access to the handle as the sleeve would cover the recess produced by the handle, so that the handle cannot be gripped.

EP-A-0 609 575, published on Aug. 10, 1994, discloses a sleeved bottle having a handle which merges with the side of the bottle at two regions (i.e. top and bottom of the handle). The sleeve is provided with a cut-out substantially corresponding to the position of the gripping handle. However, when a shrink-sleeving process is used, it has been found to be difficult to assemble the sleeve and the bottle in such a way that the size and position of the cut-out is always accurate. The cut-out must be relatively large in order to extend between both of the two merged regions of the handle and bottle, so that the cut-out region encompasses the whole handle. The relatively large cut-out is prone to misalignment and or tearing during the sleeving process. Furthermore the process may leave sharp, exposed edges of the sleeve around the cut-out region which may cause discomfort to the user or, in extreme cases, may cut the finger of the user.

The present invention addresses the problems by providing a bottle having a sleeve around the outside of the bottle, and having a handle, the handle being substantially exposed outside of the sleeve.

SUMMARY OF THE INVENTION

The process of the present invention comprises the steps of:

a) forming a bottle with a handle, the handle having opposing ends, wherein one end of the handle merges with the bottle in a merging region, and the other end of the handle is a free end;

b) forming a sleeve essentially in the shape of a tube, the sleeve having at least one cut-out region which is defined on all sides by the sleeve, and wherein the profile of the cut-out region is at least as big as the cross-sectional profile of the free end of the handle;

c) opening the generally tubular sleeve and disposing the open sleeve over the bottle;

d) displacing the sleeve relative to the bottle so that the cut-out region of the sleeve is adjacent to the free end of the handle;

e) deforming the sleeve so that the cut-out region encompasses the free end of the handle;

f) displacing the sleeve relative to the bottle so that the sleeve generally surrounds the bottle, and so that the handle is disposed through the cut-out region of the sleeve; and g) shrinking the sleeve to the outer surface of the bottle.

DETAILED DESCRIPTION OF THE INVENTION

The invention relates to a decorated bottle where the means of decoration is a shrink sleeve. The term bottle hereby should be understood generally as a container for fluid products, fluid products including liquids or gels as well as flowing materials such as powders or granules.

The bottle has a base. By a base it should be understood a part of the bottle on which the bottle is left to stand up-right. This part my be flat, or may for example be formed from a moulded tripod, or from a flat ring. Many types of "base" are known in the art, the main feature of such a base being to hold the bottle in a stable position on a flat supporting surface. The bottle also has a major axis which is generally perpendicular to the plane of the base.

The bottle further comprises a top part. The top part is typically the part of the bottle opposed to the base. The top is commonly the part of the bottle which is provided with an aperture for emptying and optionally refilling the bottle. The aperture is generally provided with a closure.

The bottle also comprises sides. The sides are the surfaces which, in general terms, join the top and the base of the bottle. Typically, when the bottle is upright, the sides are substantially vertical and perpendicular to the base. The sides may also have a curved or relatively complex shape depending on the bottle considered.

Figure 1:
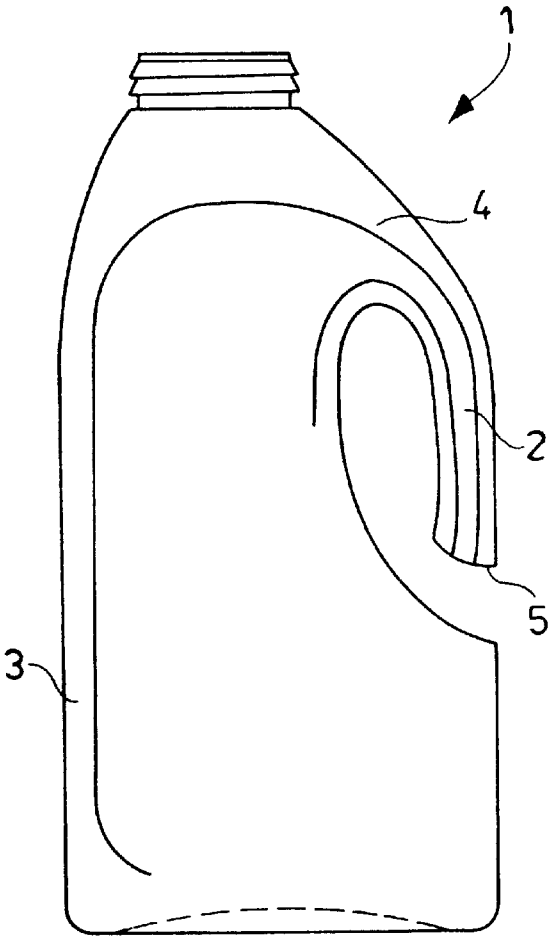
FIG. 1 shows a bottle with a side handle suitable for use in the process of the present invention (step a).

A typical bottle for use in the present invention is illustrated in FIG. 1. The bottle 3 according to the present invention further comprises a handle 2 disposed on a side of the bottle. This makes the bottle different from bottles without handles (such as, for example, typical bottles for soda or beer), and also from bottle with a handle on the top part (such as "heavy" bottles of the type used for containing more than 5 liters of petrol for example). The handle 2 is joined to the side of the bottle 3 at a merging region 4. The handle 2 according to the invention is, for example, forming a recess in the generally vertical direction when the bottle 3 is standing upright upon its base, the recess being such that a user may slide the hand in the recess to hold, lift and pour from the bottle.

Figure 8:
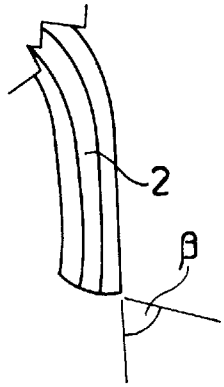
FIG. 8 illustrates the angle (B) subtended in the vertical plane at the outer edge of the free end of the handle.

The free 5 end of the handle 2 is preferably shaped to facilitate its insertion into, and passage through, the cut-out region 7 of the sleeve 6 in the process that will be described in more detail below. Accordingly, as shown in FIG. 8, it is preferred that the angle (β) subtended in a vertical plane at the outer edge of the free end of the handle is a rather acute angle, preferably less than about 80°, more preferably less than 65°.

The bottle 3 may be formed by any convenient means, blow-molding being the most commonly used. Preferably the bottle 3 has an internal volume of at least 1 liter and of less than 5 liters, and more preferably less than 3 liters.

Further, the bottle is shrink-sleeved. Shrink-sleeving consists in enveloping a part of the bottle in a tube-like flexible sleeve. Preferably the material of the sleeve is thermoplastic, and the sleeve is heated to shrink closely around the outer surface of the bottle. The sleeve may be made from a single film of plastic, or laminated in two or more layers. The plastic film may be either coloured or glass clear transparent glossy film which will be printed upon, or, alternatively, in the case of a laminated film, at least one layer of film may be pigmented by the addition of dyes or pigments before or at the point of extruding the laminate. The plastic film may also be decorated with colours, designs, logos, usage instructions, health and regulatory symbols and warnings, and other written or graphical information. This may be done by flexo- or gravure-printing. A preferred method, known as reverse printing, is to print the colours on the inside of the label in order to maintain its glossiness. The sleeve is formed by forming the plastic film essentially into a tube, preferably by folding the film back upon itself and forming a seam, and cutting the tube to form individual sleeves.

Figure 2:
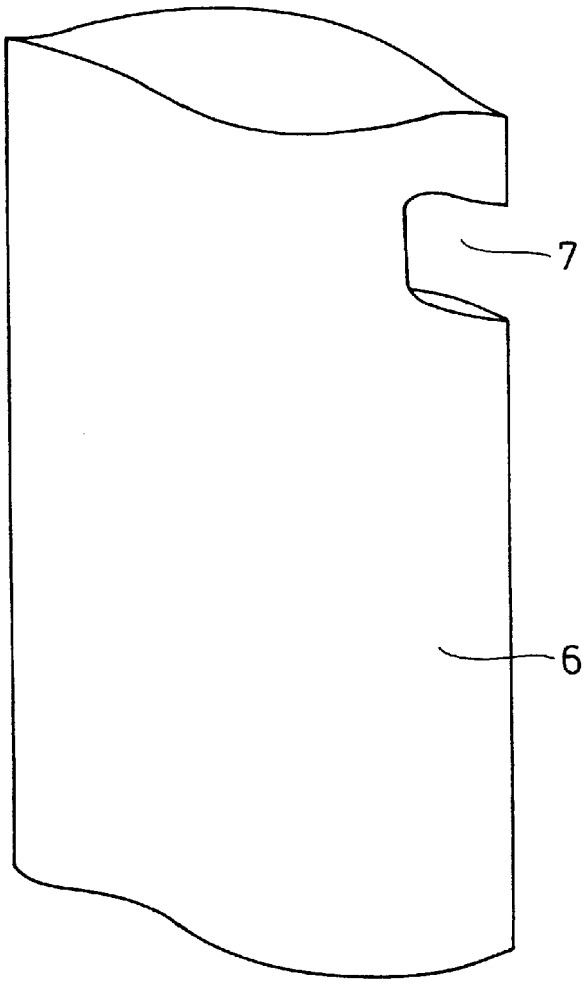
FIG. 2 shows a sleeve with a cut-out region suitable for use in the process of the present invention (step b).

According to the present invention, illustrated in FIG. 2, a cut-out 7 is made in the sleeve 6. The cut-out 7 is surrounded on all of its sides by the plastic film material of the sleeve 6 which defines a hole in the sleeve. The profile of the cut-out region is at least as big as the cross-sectional profile of the free end 5 of the handle 2. Preferably the profile of the cut-out is generally round or oval-shaped, or it may be square or rectangular with rounded corners. Sharp corners are preferably avoided because these tend to distort or tear when the sleeve is shrunk.

The cutting of the sleeve, and the forming of the cut-out 7 within the sleeve 6, can be achieved by various means such as mechanical die cutting, laser cutting or water jet cutting.

Figure 4:
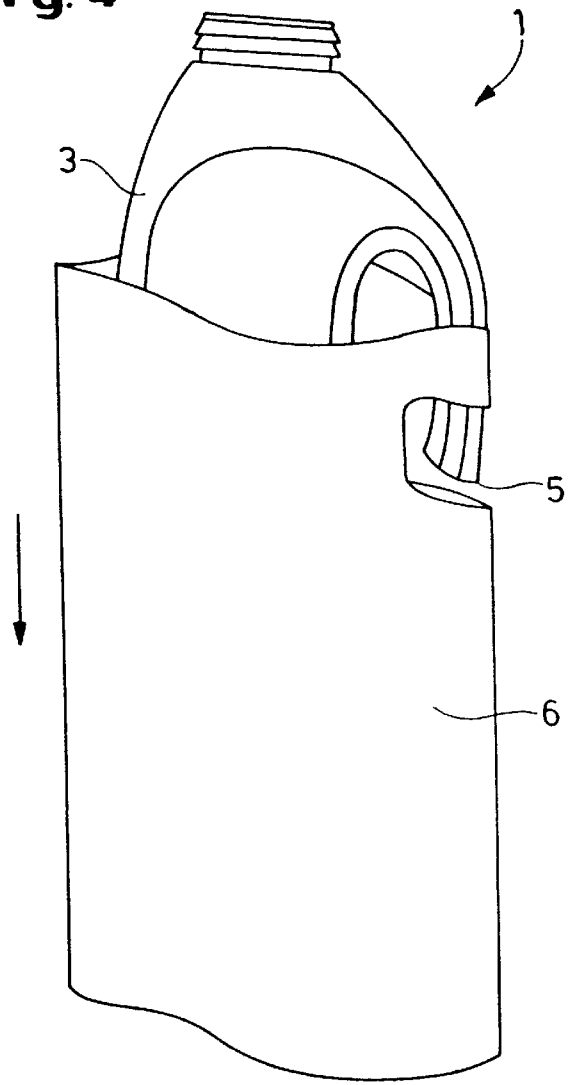
FIG. 4 shows the displacement of the sleeve relative to the bottle so that the cut-out region of the sleeve is adjacent to the free end of the handle (step d of the process of the present invention).
Figure 3:
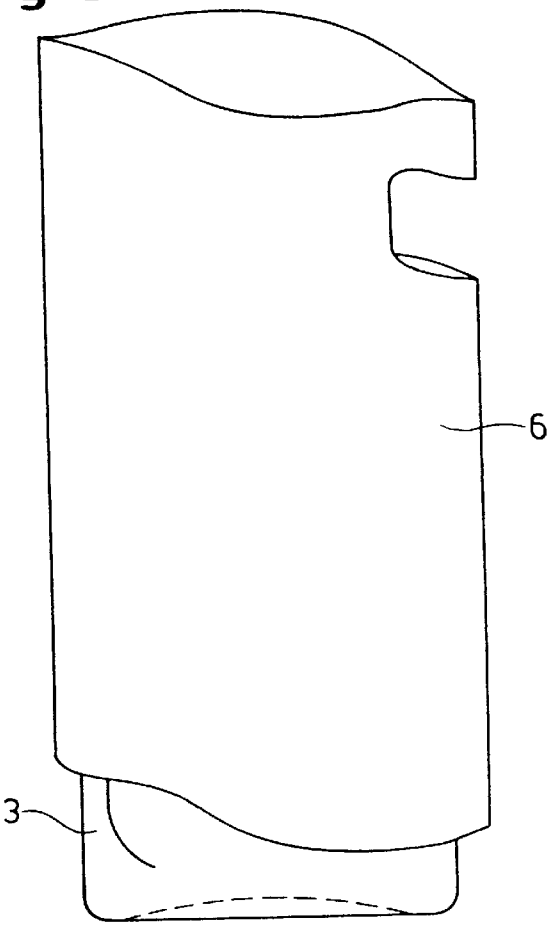
FIG. 3 shows the open sleeve of FIG. 2 placed over and around the bottle of FIG. 1.
Figure 6:
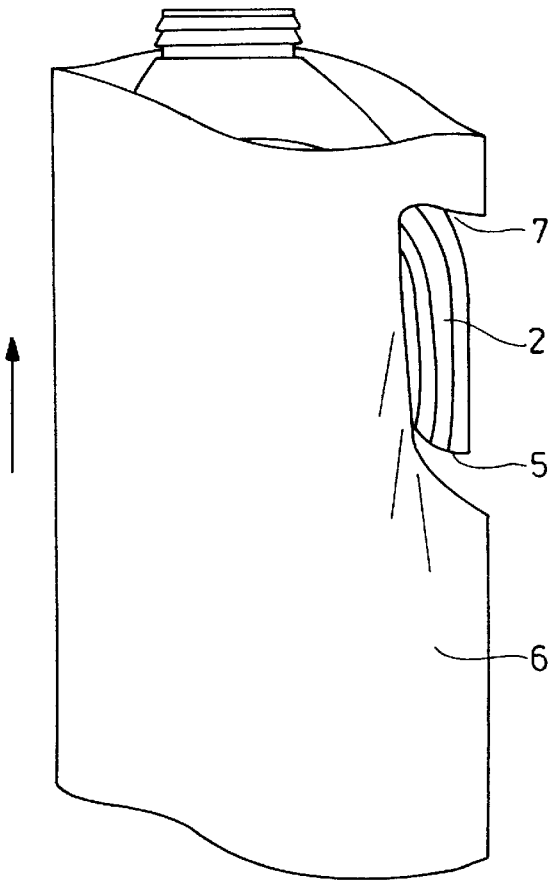
FIG. 6 shows the displacement of the sleeve relative to the bottle so that the sleeve generally surrounds the bottle, and so that the handle is disposed through the cut-out region of the sleeve handle (step f of the process of the present invention).
Figure 5:
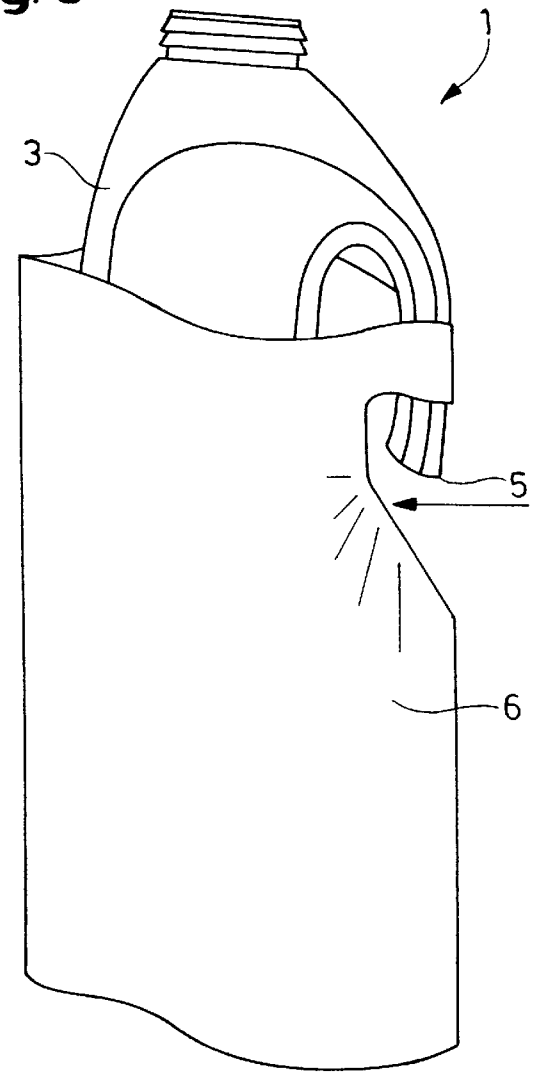
FIG. 5 shows the deformation of the sleeve so that the cut-out region encompasses the free end of the handle (step e of the process of the present invention).

According to the present invention the sleeve 6, in the form of an open tube, is disposed over and around the bottle 3 (FIG. 3). The sleeve 6 is displaced relative to the bottle 6 so that the cut-out region 7 of the sleeve is adjacent to the free end 5 of the handle (FIG. 4). This allows the cut-out region 7 of the sleeve 6 to be positioned around the free end 5 of the handle 2. The sleeve 6 is then deformed (FIG. 5) adjacent to the cut-out region 7 so that the cut-out region 7 encompasses the free end 5 of the handle 2 and the sleeve 6 is subsequently displaced so that the sleeve 6 generally surrounds the bottle 3, and the handle 2 is disposed through, and protrudes out of, the cut-out region 7 of the sleeve 6 (FIG. 6). The result of this process is that the handle 2 is pushed through the cut-out 7 of the sleeve 6 until the sleeve 6 substantially surrounds the outer surface of the bottle and the handle 2 is disposed though the cut-out 7. The handle 2 is thus exposed outside of the sleeve 6.

The sleeving process can be carried out on conventional bottle sleeving apparatus. It is necessary only to modify such apparatus by providing the means by which the sleeve 6 is deformed so that the cut-out region 7 of the sleeve 6 encompasses the free end 5 of the handle 2. Such a deforming means could, for example, be a cam in combination with a deforming bar.

In alternative embodiments of the invention the bottle is held with its major axis in a vertical plane and either the bottle is maintained without vertical displacement while the sleeve is displaced vertically relative to the bottle; or the sleeve is maintained without vertical displacement while the bottle is displaced vertically relative to the sleeve. Of course a combination of both embodiments is possible provided the sleeve and bottle are displaced relative to one another.

The shrinking of the sleeve around the outer surface of the bottle is preferably carried out by passing the bottle and the sleeve through a shrink tunnel in which hot steam or hot air is blown onto the sleeve causing it to shrink and take the shape of the bottle. Alternatively infrared radiation may be used. The finished shrink-sleeved bottle is illustrated in FIG. 7.

Preferably the shrunk sleeve covers at least 30% of the outer surface of the bottle, and preferably covers at least 50% of the outer surface of the bottle, and more preferably covers at least 70% of the outer surface of the bottle.

Figure 7:
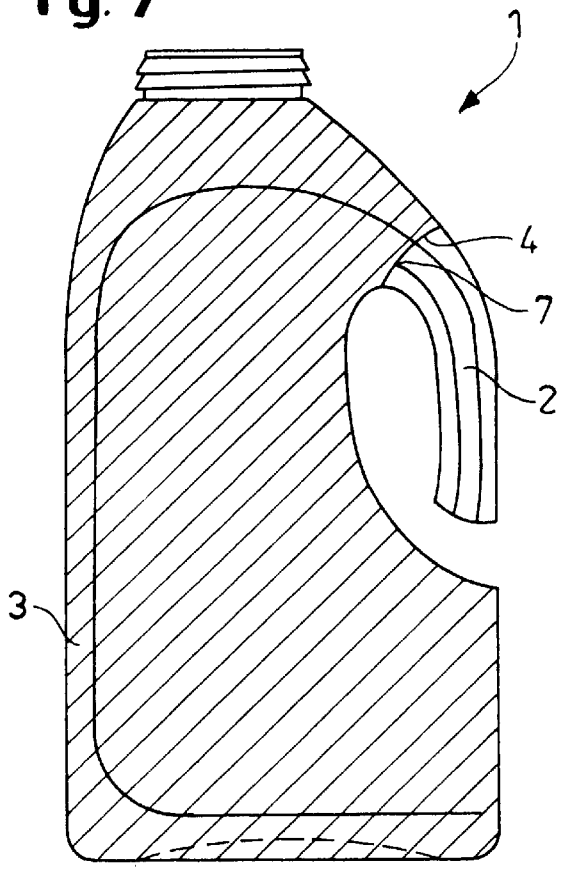
FIG. 7 shows an example of a finished shrink-sleeved bottle made according to the process of the present invention.

In a particularly preferred embodiment of the present invention the cut-out region 7 of the sleeve 6 is juxtaposed with the merging region 4 between the handle 2 and the bottle 3 after the sleeve has been shrunk to the outer surface of the bottle, as illustrated in FIG. 7. This maximises the surface of the bottle which is covered by the sleeve, and consequently provides the greatest surface area which can be decorated as described hereinabove.

What is claimed is:

1. A process for the manufacture of a bottle, the bottle having a sleeve around the outside of the bottle, and having a handle, the handle being substantially exposed outside of the sleeve, wherein the process comprises the steps of:

a) forming a bottle with a handle, the handle having opposing ends, wherein one end of the handle merges with the bottle in a merging region, and the other end of the handle is a free end;

b) forming a flexible sleeve essentially in the shape of a tube, the sleeve having at least one cut-out region which is defined on all sides by the sleeve, and wherein the profile of the cut-out region is at least as big as the cross-sectional profile of the free end of the handle;

c) opening the generally tubular sleeve and disposing the open sleeve over the bottle;

d) displacing the sleeve relative to the bottle so that the cut-out region of the sleeve is adjacent to the free end of the handle;

e) deforming the sleeve so that the cut-out region encompasses the free end of the handle;

f) displacing the sleeve relative to the bottle so that the sleeve generally surrounds the bottle, and so that the handle is disposed through the cut-out region of the sleeve; and g) shrinking the sleeve to the outer surface of the bottle.

2. A process according to claim 1 wherein the sleeve comprises a thermoplastic material and the shrinking step g) comprises the application of heat.

3. A process according to claim 1 wherein the cut-out region of the sleeve is juxtaposed with the merging region between the handle and the bottle after the sleeve has been shrunk to the outer surface of the bottle.

4. A process according to claim 1 wherein in steps d) and f) the bottle is held with its major axis in a vertical plane and the bottle is maintained without vertical displacement while the sleeve is displaced vertically relative to the bottle.

5. A process according to claim 1 wherein in steps d) and f) the bottle is held with its major axis in a vertical plane and the sleeve is maintained without vertical displacement while the bottle is displaced vertically relative to the sleeve.

6. The process according to claim 1 wherein the shrunk sleeve covers at least 30% of the outer surface of the bottle.

7. The process according to claim 1 wherein the bottle has an internal volume of at least 1 liter and of less than 5 liters.

* * * * *